United States Patent [19]

Ulveling et al.

[11] Patent Number: 4,702,288

[45] Date of Patent: Oct. 27, 1987

[54] APPARATUS FOR THE PNEUMATIC INJECTION OF PULVERULENT MATERIALS INTO A PRESSURIZED VESSEL, AND ITS APPLICATION TO THE INJECTION OF POWERED COAL INTO A SHAFT FURNACE

[75] Inventors: Leon Ulveling, Howald; Louis Schmit; Edouard Legille, both of Luxembourg, all of Luxembourg

[73] Assignee: Paul Wurth S.A., Luxembourg

[21] Appl. No.: 898,526

[22] Filed: Aug. 21, 1986

[30] Foreign Application Priority Data

Aug. 21, 1985 [LU] Luxembourg ..... 86.048

[51] Int. Cl.[4] ..... B65B 1/04

[52] U.S. Cl. ..... 141/67; 141/286; 414/21; 414/291

[58] Field of Search ..... 414/21, 291, 292, 294, 414/295, 299, 328, 373, 397, 786; 141/1, 286, 4, 248, 5, 67, 68, 83, 233, 263, 387, 388; 222/450; 177/59; 406/3, 30

[56] References Cited

U.S. PATENT DOCUMENTS

| | | | |
|---|---|---|---|
| 4,106,533 | 8/1978 | Herzig | 141/248 |
| 4,465,419 | 8/1984 | Stratmann et al. | 141/67 |
| 4,545,410 | 10/1985 | Paul et al. | 141/67 |

*Primary Examiner*—Houston S. Bell, Jr.

*Attorney, Agent, or Firm*—Fishman & Dionne

[57] ABSTRACT

An apparatus is presented for the pneumatic injection of pulverulent materials into a pressurized vessel, comprising a storage silo, a distribution silo, a series of metering devices for extracting the pulverulent materials from the distribution silo, pneumatic conveying pipes connecting each of the metering devices to the vessel, and also a device for the automatic transfer of the pulverulent material from the storage silo (which is under substantially atmospheric pressure) to the distribution silo in which a pressure higher than that in vessel prevails. An important feature of the present invention is the presence of two intermediate silos each connected via automatic valves, upstream to the storage silo and, downstream, to the distribution silo; and by a pressurizing circuit connecting a source of inert gas under pressure through automatic valves to each of the intermediate silos.

11 Claims, 1 Drawing Figure

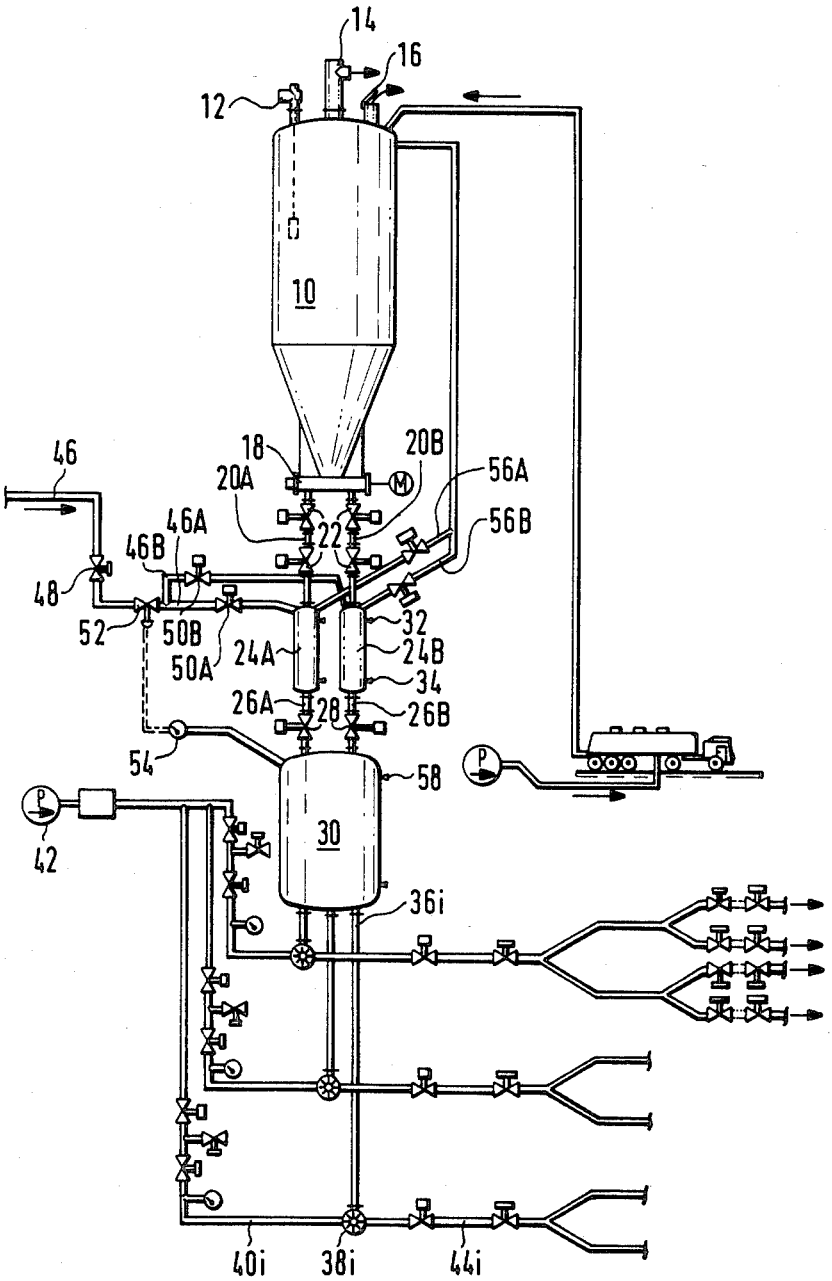
14
16
12
10
18
20B
20A
56A
46
46A
22
56B
46B
48
52
50B
50A
24A
32
24B
34
26A
28
26B
54
58
42
30
36i
40i
38i
44i

APPARATUS FOR THE PNEUMATIC INJECTION OF PULVERULENT MATERIALS INTO A PRESSURIZED VESSEL, AND ITS APPLICATION TO THE INJECTION OF POWERED COAL INTO A SHAFT FURNACE

BACKGROUND OF THE INVENTION

This invention relates to an apparatus for the pneumatic injection of pulverulent materials into a pressurized vessel comprising a storage silo, a distribution silo, a series of metering means for extracting the pulverulent materials from the distribution silo, pneumatic conveying pipes connecting each of the metering means to the vessel, and also means for the automatic transfer of the pulverulent material from the storage silo (which is under substantially atmospheric pressure) to the distribution silo in which a pressure higher than that in the vessel prevails. Although not limited to this application, the present invention will be described with reference to its most advantageous application, namely the injection of solid fuels into a shaft furnace.

An apparatus of the kind described above is known from the patent application EP-A-No. 0 079 444 corresponding to U.S. Pat. No. 4,593,727, which is assigned to the assignee hereof, all of the contents of which are incorporated herein by reference. In the prior apparatus described in U.S. Pat. No. 4,593,727, the pulverulent material is transferred from the storage silo to the distribution silo by way of an intermediate silo serving as a lock chamber. This intermediate silo is connected alternately by means of a set of valves to the storage silo and to the distribution silo; in other words, it is alternately pressurized and vented. In view of the fact that the pulverulent material is continuously extracted from the distribution silo, that is, without interruption, it is necessary for the volume of the intermediate silo to be relatively large in order to enable sufficient material to be transferred to the distribution silo to ensure that there will be no interruption during the filling of the intermediate silo. Similarly, the pipes and valves must be sufficiently wide to reduce the time required for transfer from one silo to the other. Furthermore, in order to permit the venting of the intermediate silo and ensure the security of the distribution silo, these two silos are connected via sets of valves to a vent pipe provided with a filter. However, while suitable for its intended purposes, all of these conditions, requirements and precautionary measures make the installation described in U.S. Pat. No. 4,593,727, relatively complex, cumbersome and consequently relatively expensive.

SUMMARY OF THE INVENTION

The above-described problems and deficiencies of the prior art are overcome or alleviated by the apparatus for the pneumatic injection of pulverulent materials into a pressurized vessel of the present invention. In accordance with the present invention, an improved apparatus of the type described in U.S. Pat. No. 4,593,727, which is simpler and is particularly suitable for small volumes is provided. The apparatus of the present invention includes (as an important feature), two intermediate silos each connected via automatic valves, upstream to the storage silo and, downstream, to the distribution silo; and a pressurizing circuit connecting a source of inert gas under pressure through automatic valves to each of the intermediate silos. These intermediate silos, which also serve as lock chambers between the storage silo and the distribution silo, operate alternately, that is, one intermediate silo is connected to the storage silo in order to be filled, while the other is connected to the distribution silo for the purpose of emptying its contents into the latter.

The presence of two alternately operating intermediate silos permits almost continuous filling of the distribution silo in rhythm with the extraction of the pulverulent material from the latter. This makes it possible to not only reduce the volume of each of the intermediate silos, but also to reduce the cross-section of the pipes and valves associated therewith. As an example, if pipes in the known installation must have a diameter of 300 millimeters, those pipes provided in the installation of the present invention have a diameter of only 50 millimeters. Significantly, the capacity of each of the intermediate silos can be reduced to 0.5 cubic meters for a distribution silo capacity on the order of 7 cubic meters.

The small volume of the intermediate silos permits the decompression thereof via the storage silo. This provides the dual advantage that the intermediate silos do not have to be provided with a vent pipe and a filter, on the one hand, and that the material in the storage silo is fluidized at the moment when the intermediate silos are vented, on the other hand, thereby permitting a better flow from the storage silo.

In accordance with another important feature of the present invention, the pressurization circuit comprises a pressure gauge monitoring the pressure in the distribution silo and a regulating valve for compensating, via the intermediate silos, the pressure losses occurring in the distribution silo. Such pressure losses result because of the extraction of pulverulent material and the opening of the valves effecting communication between the intermediate silos and the distribution silo, while the latter is pressurized via the intermediate silos.

The fact that the intermediate silos are no longer pressurized before the opening of the valve effecting communication with the distribution silo, and that the pressure of the latter is regulated via each of the intermediate silos, provides two advantages. Firstly, at the moment when the valve effecting communication between the distribution silo and one of the intermediate silos is opened, the high pressure in the distribution silo is distributed to the intermediate silo until the pressures in the two silos are equal and the rising of gas under pressure in the intermediate silo brings about the fludization of the pulverulent material in the latter. This pressure equalization between the two silos entails a pressure drop on the order of some tenths of a bar in the distribution silo. This lowering of the pressure is compensated by the injection of inert gas under pressure into the top or upper portion of the intermediate silo which is in communication with the distribution silo. This provides the advantage that the gas injected into the intermediate silo serves as propulsion fluid for the pulverulent material and permits faster and more complete emptying of the intermediate silo.

In yet another feature of the present invention, an agitator is provided at the outlet of the storage silo in order to keep the material in movement and to ensure a better flow to the intermediate silos.

The above described and other features and advantages of the present invention will be apparent to and understood by those skilled in the art from the following detailed description and drawing.

BRIEF DESCRIPTION OF THE DRAWINGS

Referring now to the single FIGURE in the drawing, a general schematic diagram is shown of an installation for injecting pulverulent material (i.e., powered coal) into a vessel (i.e., shaft furnace) in accordance with the present invention.

DESCRIPTION OF THE PREFERRED EMBODIMENT

Powered coal, (or other pulverulent material) which is, for example, transported by tanker lorry or by rail, is transferred to a storage silo 10 having a high capacity (for example 100 cubic meters). The level in storage silo 10 is monitored by a level probe 12 which signals the need for replenishment with coal. Silo 10 is, in addition, provided with an atmospheric vent with a filter 14, and with a bleeder valve 16 to permit the resorption of accidental shock waves.

An agitator 18 is provided at the outlet of silo 10 for continuously agitating the powered coal in order to assist its flow out of silo 10. Agitator 18 opens the path to two parallel pipes 20A and 20B, each being provided with automatic closure valves 22. Two intermediate silos 24A and 24B of low capacity (for example 0.5 cubic meter), are connected upstream to the two pipes 20A and 20B and downstream, via pipes 26A and 26B (each provided with automatic valves 28) to a distribution silo 30.

Each of the intermediate silos 24A and 24B is associated with a top level probe 32 intended for the automatic control of the closing of valves 22 during the filling of the intermediate silo; and also a bottom level probe 34 which is intended for automatically controlling the closing of the corresponding valve 28 during the discharge of the intermediate silo to feed the distribution silo 30.

The base of distribution silo 30 has a series of flow pipes $36_i$, the number of which depends on the number of tuyeres provided in the shaft furnace into which the powered coal is injected. Each of pipes $36_i$ leads into a metering means $38_i$ (for example of the cellular rotor type having a variable speed motor), for the purpose of extracting predetermined, adjustable amounts of powered coal. Each of metering means $38_i$ is connected via a pressurized air pipe $40_i$ to a compressor 42 for the purpose of propelling the metered amounts of powered coal through pipes $44_i$ to each of the tuyeres of the shaft furnace.

In view of the fact that distribution silo 30 must continuously be under a higher pressure than that prevailing in the shaft furnace, and that storage silo 10 is continuously under substantially atmospheric pressure, intermediate silos 24A and 24B must serve as lock chambers between these two chambers. For this purpose, a pressurization circuit is provided which is fed by a pipe 46 with inert gas under pressure, such as, for example, nitrogen. Pipe 46 has a closure valve 48 and an automatic regulating valve 52 controlled by a pressure gauge 54. Pressure gage 54 measures the pressure inside distribution silo 30. Downstream of regulation valve 52, pipe 46 divides into two branches 46A and 46B, each provided with an automatic valve 50A and 50B and leading respectively into the upper or top portion of intermediate silos 24A and 24B.

Intermediate silos 24A and 24B additionally communicate with each other via two vent pipes 56A, 56B, with the storage silo 10 in order to permit evacuation of air proportionally as the silos 24A, 24B are being filled.

A description will now be given of the operation of the apparatus described above. It will first be assumed that intermediate silo 24A is in communication via pipe 20A and its open valves 22 with the storage silo 10; and that the valve 28 blocks communication between this silo 24A and the distribution silo 30. For intermediate silo 24B, the situation is the reverse, that is, valves 22 block communication with the storage silo 10, while the open valve 28 establishes communication between the intermediate silo 24B and the distribution silo 30. As a result, powdered coal flows from the storage silo 10 through the agitator 18 and into the intermediate silo 24A. At the same time, the contents of the intermediate silo 24B flow into the distribution silo 30. When top level probe 32 detects the filling of silo 24A, it automatically interupts communication with silo 10 by closing the corresponding valves 22. At the same time, the emptying of silo 24B ends (which is detected by the level probe 34 or a top level probe 58 associated with the distribution silo 30). Valve 28 which allowed communication between silo 24B and silo 30 is then closed automatically.

As soon as communication between storage silo 10 and intermediate silo 24 is interrupted, valve 28 is opened to establish communication between silo 24A and distribution silo 30. The opening of this valve causes gas under pressure in the silo 30 to rise into silo 24A until the pressures in these two silos are equalized. This pressure equalization is accompanied by agitation and fludization of the powdered coal in silo 24A. During this relatively rapid phase, a pressure drop on the order of a few tenths of a bar occurs in silo 30, which is detected by pressure gauge 54. The latter controls the opening of valves 52 and 50A to permit the injection of gas under pressure into silo 24A until compensation for the pressure drop in silo 30 is achieved. Any loss of pressure in silo 30 resulting from establishment of communication with one of the silos 24 of the extraction of pulverulent material is thus achieved via the corresponding intermediate silo, and not via the special pipes which are provided for that purpose in the installations of the prior art. This obviously provides the advantage of saving pipes for the pressurization of silo 30; and also the advantage that the pulverulent material (coal) is propelled out of silo 24 by means of gas under pressure which is injected through pipe 46A.

During this time, intermediate silo 24B is placed in communication with storage silo 10 through the opening of valves 22. As soon as these valves open, the pressure in silo 24B is resorbed in the much larger column of the storage silo 10. The venting of the intermediate silos by way of silo 10 is, of course, made possible by the small volume of the silos 24 in comparison with that of the storage silo 10, and offers the dual advantage of (1) effecting fludization in silo 10; and (2) making superfluous any separate vent pipes and filters for the intermediate silos 24. As soon as the pressurized gas has escaped from silo 24B, the powdered coal can flow from the the storage silo 10 by way of pipe 20B into silo 24B, while surplus air can escape as filling proceeds, passing through the vent pipe 56B into silo 10. It should be noted that the automatic valves in the vent pipes 56A, 56B are opened only after the decompression of the silos 24 when the flow from the silo 10 has been started.

The filling of silo 24B ends practically at the same time as the emptying of adjacent silo 24A, which is detected by the level probes 32 and 34. The cycle then starts again through the reversal of the valves, i.e., the filling of the silo 24A and the emptying of the silo 24B.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. An apparatus for the pneumatic injection of pulverulent materials into a pressurized vessel, comprising a storage silo, a series of metering means for extracting the pulverulent material from the distribution silo, pneumatic conveying pipes connecting each of the metering means to the pressurized vessel, and also means for the automatic transfer of the pulverulent material from the storage silo, which is under substantially atmospheric pressure, to the distribution silo in which a pressure higher than that in the vessel prevails, including:

two intermediate silos, each intermediate silo being connected by first automatic valve means upstream to the storage silo and by second automatic valve means downstream to the distribution silo;

pressurizing circuit means connecting a source of inert gas under pressure through third automatic valve means to each of said intermediate silos; and wherein said two intermediate silos are alternately connected to said storage silo and to said distribution silo to enable substantially continuous transfer of pulverulent material from said storage silo to said distribution silo.

2. The apparatus according to claim 1 wherein said pressurizing circuit means comprises:

two conduit branches which are associated with said third automatic valve means and which lead respectively, into the upper portion of each of said intermediate silos.

3. The apparatus according to claim 1 wherein said pressurizing circuit means comprises:

pressure gauge means monitoring the pressure in the distribution silo; and regulating valve means for compensating, via said intermediate silos, for pressure losses in the distribution silo.

4. The apparatus according to claim 1 including:

agitator means located at the outlet of the storage silo.

5. The apparatus according to claim 2 including:

agitator means located at the outlet of the storage silo.

6. The apparatus according to claim 3 including:

agitator means located at the outlet of the storage silo.

7. The apparatus according to claim 1 including:

filter means on the storage silo for venting the storage silo and each of said intermediate silos.

8. The apparatus according to claim 2 including:

filter means on the storage silo for venting the storage silo and each of said intermediate silos.

9. The apparatus according to claim 3 including:

filter means on the storage silo for venting the storage silo and each of said intermediate silos.

10. The apparatus according to claim 4 including:

filter means on the storage silo for venting the storage silo and each of said intermediate silos.

11. The apparatus of claim 1 wherein said vessel is a shaft furnace.

* * * * *